United States Patent [19]

Yoshida et al.

[11] Patent Number: 4,499,366

[45] Date of Patent: Feb. 12, 1985

[54] CERAMIC HEATER DEVICE

[75] Inventors: Hitoshi Yoshida, Kariya; Morihiro Atsumi, Okazaki; Nobuei Ito, Aichi; Kinya Atsumi, Toyohashi, all of Japan

[73] Assignees: Nippondenso Co., Ltd., Kariya; Nippon Soken, Inc., Nishio, both of Japan

[21] Appl. No.: 554,107

[22] Filed: Nov. 21, 1983

[30] Foreign Application Priority Data

Nov. 25, 1982 [JP] Japan ..... 57-206373
Feb. 8, 1983 [JP] Japan ..... 58-19947
Mar. 17, 1983 [JP] Japan ..... 58-45542

[51] Int. Cl.[3] ..... F23Q 7/22

[52] U.S. Cl. ..... 219/270; 29/611; 123/145 A; 219/541; 219/553; 252/518; 361/266

[58] Field of Search ..... 219/260, 267, 270, 553; 123/145 A, 145 R; 361/264, 265, 266; 431/262; 338/330, 217; 373/134; 252/518, 520; 501/96

[56] References Cited

U.S. PATENT DOCUMENTS

| | | | |
|---|---|---|---|
| 3,002,936 | 10/1961 | Allenbach et al. | 252/518 |
| 3,095,492 | 6/1963 | Gaiennie | 338/217 X |
| 3,248,346 | 4/1966 | Amberg | 252/518 |
| 3,372,305 | 3/1968 | Mikulec | 361/266 X |
| 3,875,477 | 4/1975 | Fredriksson et al. | 219/270 X |
| 4,090,054 | 5/1978 | Heine et al. | 219/553 X |
| 4,107,510 | 8/1978 | Tombs et al. | 219/270 |
| 4,125,756 | 11/1978 | Hierholzer et al. | 219/121 LM |
| 4,401,065 | 8/1983 | Minegishi et al. | 123/145 A |
| 4,425,692 | 1/1984 | Minegishi et al. | 29/611 |
| 4,426,568 | 1/1984 | Kato et al. | 219/270 |

FOREIGN PATENT DOCUMENTS 5495628 12/1977 Japan .

*Primary Examiner*—Volodymyr Y. Mayewsky
*Attorney, Agent, or Firm*—Cushman, Darby & Cushman

[57] ABSTRACT

A ceramic heater device has a housing section and a heating section. The heating section includes a sintered ceramic insulator attached to a metal housing and a U-shaped sintered ceramic heater body fixed to the insulator, so that the heater body is supported by the housing section by means of the insulator in order to avoid a direct connection between the metal housing and the heater body. As a result, heat generated at the heater body may not be transferred to the metal housing, and thereby the heat can be effectively used to ignite a mixture of air and fuel in an engine and a rigid and stable support of the heater body to the metal housing can be obtained.

5 Claims, 19 Drawing Figures

CERAMIC HEATER DEVICE

BACKGROUND OF THE INVENTION

The present invention relates to a ceramic heater device, for example, used as a glow plug for a diesel engine.

In a prior art ceramic heater device, for example, disclosed in a Japanese Utility Model Publication No. 54-95628, a cup-shaped heater body is made of a ceramic material and an open end thereof is attached to a metal housing through a metallized layer formed on an outer surface of the open end. Since in the prior art ceramic heater device of this kind, the open end of the heater body is directly connected to the metal housing, it is disadvantageous in that the heat generated at the heater body may be transferred to the metal housing resulting in that the heat can not be effectively used to ignite the air-fuel mixture in an engine combustion chamber and that a connecting portion of the heater body is used as an electrode whereby the whole portion of the heater body can not be used to generate heat.

It is a further disadvantage of the prior art heater device that heat stress may be generated at the connecting portion which acts as the electrode and through which the heat may be transferred to the metal housing, resulting in that the mechanical and/or electrical connection between the metal housing and the cup-shaped heater body may be deteriorated.

It is a further disadvantage that the specific resistance value of the heater body is decreased since the open end of the heater body is used as the electrode and this open end may not be used as a heating body.

SUMMARY OF THE INVENTION

It is therefore a primary object of the present invention to provide a ceramic heater device which overcomes the above described drawbacks.

According to the present invention, a ceramic heater device comprises a housing section and a heating section which includes a sintered ceramic insulater attached to a metal housing and a U-shaped sintered ceramic heater body fixed to the insulator.

According to another aspect of the present invention, a length(x) of an inner path of the U-shaped heater body is made larger so that the whole ceramic body can be effectively heated.

According to a further aspect of the present invention, a specific resistance value of a forward end of the U-shaped ceramic heater body is made larger than that of leg portions of the heater body so that the whole ceramic body can be effectively heated.

The other objects and features of the present invention will be more fully understood from the following description together with the attached drawings.

DETAILED DESCRIPTION OF PREFERRED EMBODIMENTS

FIRST EMBODIMENT

The present invention will now be explained in detail with reference to the accompanying drawings.

Figure 1:
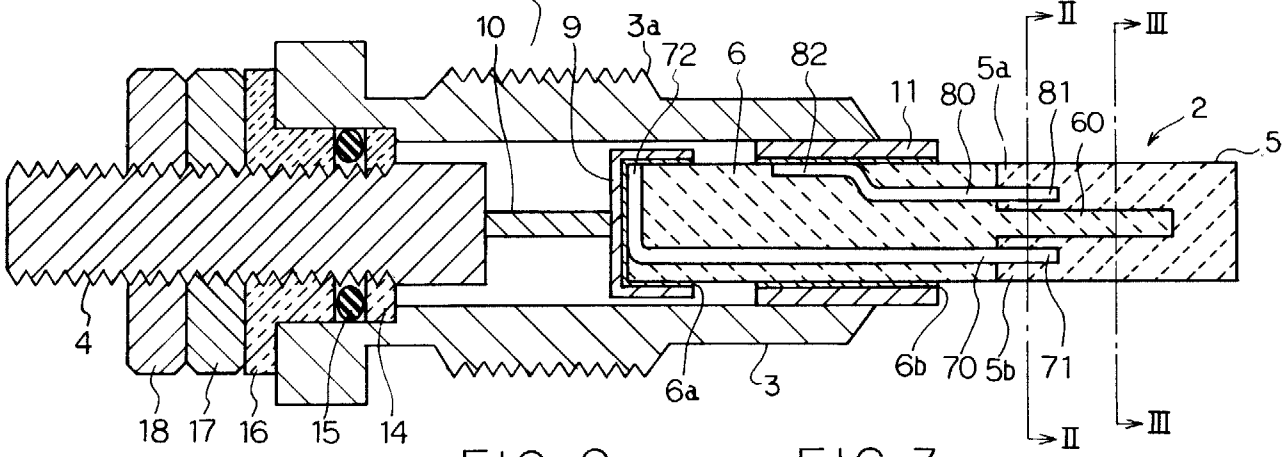
FIG. 1 is a longitudinal sectional view of a ceramic heater device according to the present invention.

In FIG. 1, numeral 1 designates an attaching (housing) section of a ceramic heater device and numeral 2 designates a heating section. The attaching section 1 includes a metal housing 3 formed with a screw portion 3*a* and a central electrode 4 acting as an electrical terminal. On the other hand, the heating section 2 includes a ceramic heater 5, an insulator 6 made of an electrically insulating ceramic material, and a pair of metal lead wires, 70, 80 embedded in the ceramic heater 5 and the insulator 6.

Figure 2:
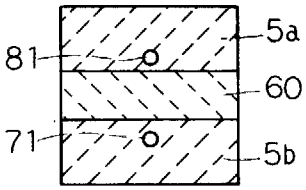
FIG. 2 is a sectional view taken along a line II—II in FIG. 1.
Figure 3:
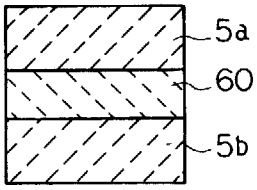
FIG. 3 is a sectional view taken along a line III—III in FIG. 1.

The ceramic heater 5 is formed as a U-letter configration and an end portion 60 of the insulator 6 is sandwiched between both ends (leg portions) 5*a* and 5*b* of the ceramic heater 5 as shown in FIG. 2.

Each end 71 and 81 of the metal lead wires 70 and 80 is electrically connected to the ceramic heater 5, respectively, as shown in FIG. 2. Each of the other ends 72 and 82 of the metal lead wires 70 and 80 is exposed to the outer surface of the insulator 6. The exposed end 72 of the metal lead wire 70 is electrically connected to a cap 9 made of a stainless steel by brazing and electrically connected to the central electrode 4 through a nickel wire 10. The exposed end 82 of the metal lead wire 80 is likewise electrically connected to a sleeve 11 made of a stainless steel by brazing and the sleeve 11 is electrically connected to the housing 3 by brazing.

In FIG. 1, numerals 6*a* and 6*b* designate metallized layers (for example, Ag-solder, Ni-solder, Cu-solder), numeral 14 designates an electrically insulating ring, numeral 15 a heat-resistive seal ring made of rubber, numeral 16 an electrically insulating bush, and numerals 17 and 18 nuts.

In the above construction, when the central electrode 4 is connected to a positive terminal of an electric power source, while the housing 3 is connected to a negative terminal of the power source, electrical current flows through the nickel wire 10, the cap 9, the lead wire 70, the ceramic heater 5, the lead wire 80, the sleeve 11 and the housing 3, whereby the ceramic heater 5 is heated.

Figure 4:
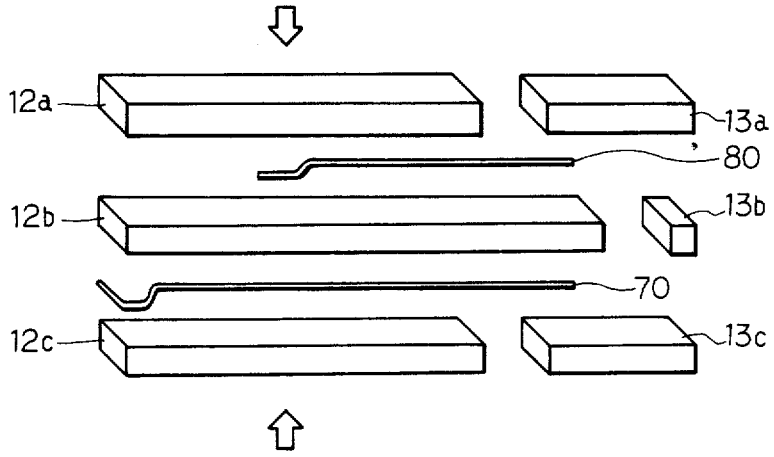
FIG. 4 is a schematic view showing a manufacturing step for a heating section, the FIGS. 5A and 5B are a front and a side view of the heating section.

A manufacturing process for the heating section will be next explained with reference to FIG. 4. Three sintered pieces 12*a*, 12*b* and 12*c* made of a mixture of $Si_3N_4$ and $Al_2O_3$ (for example, $Al_2O_3$=70 mol%, $Si_3N_4$=30 mol%) are prepared, which form the insulator 6.

Three sintered pieces 13*a*, 13*b* and 13*c* made of a mixture of $MoSi_2$ and $Si_3N_4$ (for example $MoSi_2$=70 mol%, $Si_3N_4$=30 mol%) are prepared, which form the ceramic heater 5. The pair of lead wires 70 and 80 made of Tungsten are, respectively, interposed between the pieces 12*a* and 12*b* and between the pieces 12*b* and 12*c*. The above elements are then sintered, for example, in a nitrogen($N_2$) atmosphere, at a temperature of 1630° C., for two hours, and with a pressure of 300 Kg/cm$^2$, the pressure being applied to the pieces 12*a* to 12*c* and 13*a* to 13*c* in a direction indicated by arrows in FIG. 4.

Figure 5A:
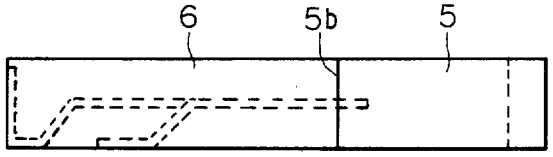
Figure 5B:
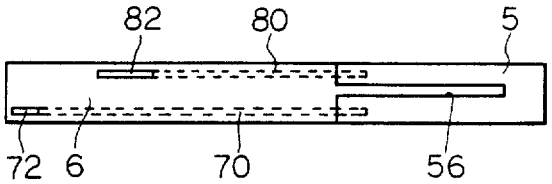

FIGS. 5A and 5B show a front elevation and a side view of a sintered body manufactured as above. In the sintered body, the pieces 12*a* to 12*c* are integrated to form the insulator 6, while the pieces 13*a* to 13*c* are integrated to form the ceramic heater 5 having a U-letter configuration.

In a boundary portion 56 between the ceramic heater 5 and the insulator 6, $Si_3N_4$ contained in the respective pieces are diffused into the other pieces, so that the heater 5 and the insulator 6 are firmly fixed with each other. As already described, each one end of the lead wires 70 and 80 is electrically connected to and at both ends of the U-shaped ceramic heater 5 and each other end 72 and 82 is exposed to the outer surface of the insulator 6.

It is taken into account that thermal expansion coefficients of the insulator 6, the ceramic heater 5 and the lead wires 70 and 80 are matched with one another.

The above-described ceramic heater device according to the present invention is compared with the prior art ceramic heater device through kinds of experiments.

Figure 6:
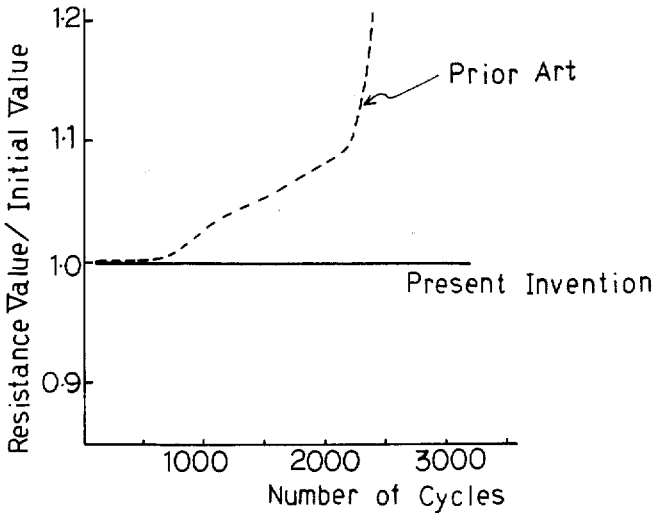
FIGS. 6 to 9 are graphs showing experimental results between the present invention and the prior art.

FIG. 6 shows a result of an endurance test, wherein an intermittent current supply is repeated, one cycle of which is one-minute current supply (temperature at outersurface of the heater is increased to 1200° C.) and then one-minute current cutoff. As seen from FIG. 6, the prior art heater device is deteriorated as the number of current supply cycles is increased, while the performance of the heater device according to the present invention is stable because the resistance valve thereof is not changed after the endurance test. The reasons of the deterioration of the prior art device are that metallized layers between the ceramic heater and the metal housing are peeled off and that thermal stresses are applied to such a portion where the ceramic heater is directly contacted to the metal housing since in such a contacting portion the heat may be easily transferred from the ceramic heater to the metal housing.

Figure 7:
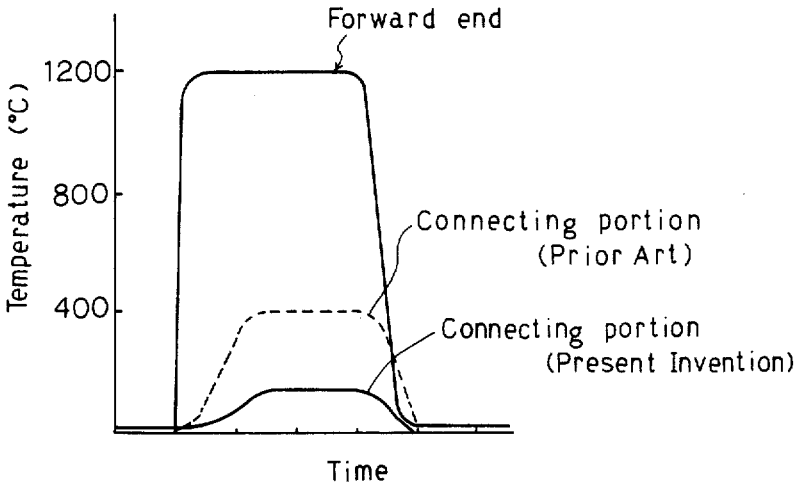

FIG. 7 shows measured temperatures at the forward end of the heater and at the contacting portions, between the metal housing and the heater (prior art) and between the metal housing and the insulator (present invention). As understood from FIG. 7, the temperature at the contacting portion of the prior art device is, by more than twice, higher than that of the present invention.

Figure 8:
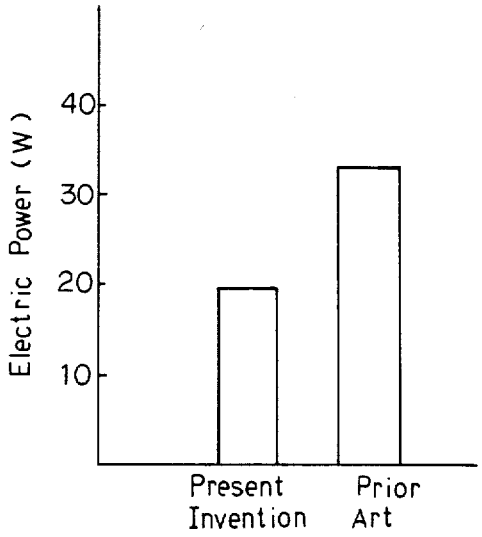

FIG. 8 shows power consumptions required for keeping the temperature of the heater at 800° C. Since the heating section is formed only at the forward end of the heater device according to the present invention, excess heat generation can be avoided and heat generated at this section may not be transferred to the housing, whereby the power consumption for the present invention is less than that of the prior art as shown in FIG. 8.

Figure 9:
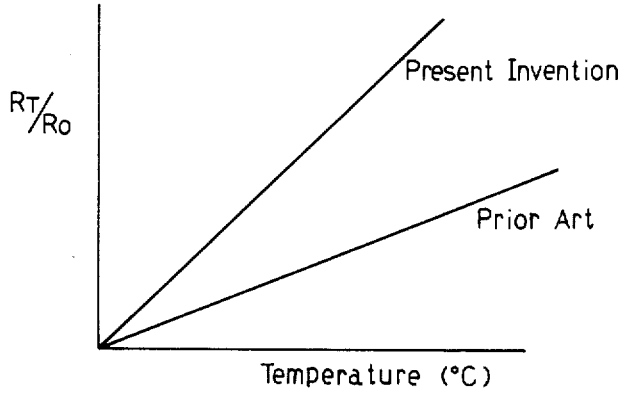

FIG. 9 shows measured resistance values with respect to the temperature of the heater section. The resistance value to the initial resistance value increases as the temperature of the heater section increases and this increase rate of the present invention is higher than that of the prior art since the whole heating section according to the present invention can be heated. The higher temperature resistance coefficient is preferable to control the heater device.

In the above described first embodiment, TiC or TiN may be used for the ceramic heater instead of $MoSi_2$, or another metal lead wire having a higher melting point, such as molybdenum(Mo), may be used. The above described first embodiment has the following advantages:

(1) Since the ceramic heater is connected to the metal housing by means of the insulator, the heat generated at the ceramic heater may not be transferred to the metal housing and thereby the heat can be effectively used, for example, to ignite a mixture of air and fuel in combustion chambers of an engine.

(2) The insulator as well as the ceramic heater can be firmly fixed to the housing.

(3) Since a portion of the insulator extends between both ends of the U-shaped ceramic heater, the insulator and the ceramic heater can be firmly integrated.

(4) The whole ceramic heater can be heated.

SECOND EMBODIMENT

The second embodiment of the present invention will be explained with reference to FIGS. 10 to 15.

Figure 10A:
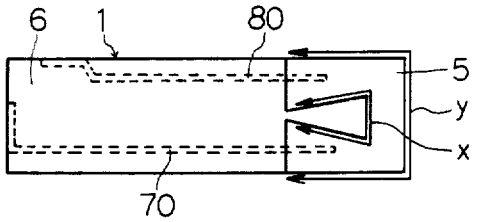
FIGS. 10A and 10B are a front and a side view of a heating section according to a second embodiment of the present invention.
Figure 10B:
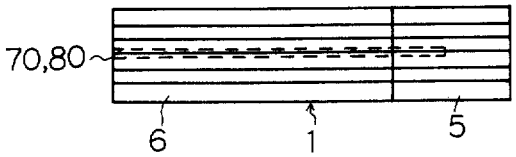

FIGS. 10A and 10B show front elevation and a side view of a heating section 1 comprising an insulator 6 and a heater body 5.

Figure 11:
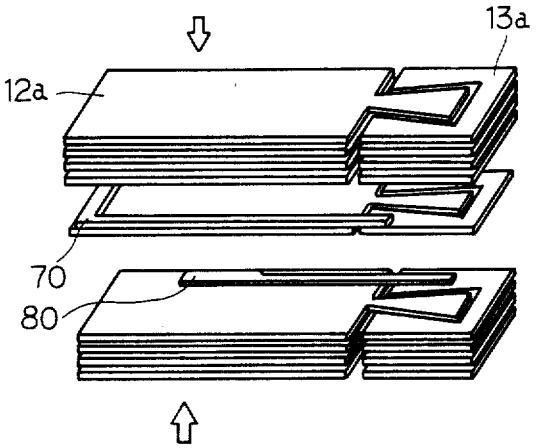
FIG. 11 is a schematic view showing a manufacturing step for the heating section.

The heating section 1 is manufactured in accordance with the following processes. A plurality of green sheets 12*a* made of a mixture of $Al_2O_3$ (70 mol%) and $Si_3N_4$ (30 mol%) and a plurality of green sheets 13*a* made of a mixture of $MoSi_2$ (70 mol%) and $Si_3N_4$ (30 mol%) are prepared as shown in FIG. 11. These green sheets 12*a* and 13*a* are piled up while a pair of metal lead wires 70 and 80 are interposed between the sheets 12*a* and 13*a*, so that each one end of the wires 70 and 80 is electrically connected to both ends of the U-shaped sheets 13*a* and each of the other ends is exposed to the outer surface of the insulator 6. Those sheets 12*a* and 13*a* and lead wires 70 and 80 are then pressed in a direction indicated by arrows in FIG. 11 at an ambient temperature and adhered to each other. Then those elements are sintered at a high temperature and with a high pressure.

Next the experimental results will be explained with reference to Table 1 and FIGS. 12 and 13.

Figure 12:
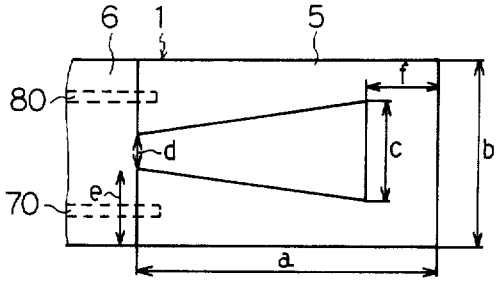
FIGS. 12 and 13 are enlarged front views of a heater body.

Twenty samples No. 1 to No. 20 are prepared, in which each dimension of a to f shown in FIG. 12 is varied as indicated in Table 1. In Table 1, x shows a length of an inner path of the U-shaped heater body 5 and y shows a length of an outer path of the heater body 5 as shown in FIG. 10.

Figure 13:
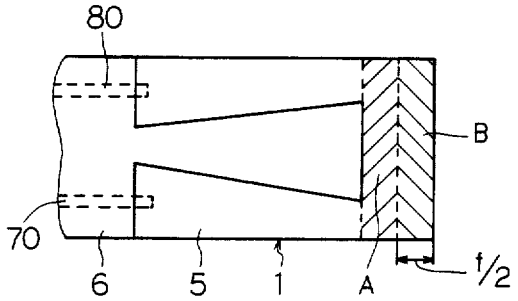

The experiments are carried out for each sample in such a manner that a temperature at a portion B shown in FIG. 13 is measured while keeping a temperature at a portion A shown in FIG. 13. In these experiments, a resistance value of the heater body 5 is 0.13Ω, an applied electric power is 9.5 volt, and the thermospot sensor is used to measure the temperatures. Each spot of luminous fluxes (1 mm ϕ) from a machine is projected to center portions of the portions A and B, respectively, and electric power is applied to the heating body 5. After the temperature indication from the thermospot sensor is stabilized, the temperature is measured for one minute and its average value is shown in Table 1.

TABLE 1

| No. | a (mm) | b (mm) | c (mm) | d (mm) | e (mm) | f (mm) | x (mm) | y (mm) | x/y | A (°C.) | B (°C.) |
|---|---|---|---|---|---|---|---|---|---|---|---|
| 1 | 10 | 4 | 0.5 | 0.5 | 1.75 | 2.0 | 16.5 | 24 | 0.68 | 1000 | 930 |
| 2 | 10 | 4 | 0.5 | 0.5 | 1.75 | 1.75 | 17.0 | 24 | 0.71 | 1000 | 930 |
| 3 | ↑ | ↑ | ↑ | ↑ | ↑ | 1.50 | 17.5 | 24 | 0.73 | 1000 | 990 |
| 4 | ↑ | ↑ | ↑ | ↑ | ↑ | 1.25 | 18.0 | 24 | 0.75 | 1000 | 1000 |
| 5 | ↑ | ↑ | ↑ | ↑ | ↑ | 1.00 | 18.5 | 24 | 0.77 | 1000 | 1000 |
| 6 | 10 | 4 | 1.0 | 1.0 | 1.5 | 1.75 | 17.5 | 24 | 0.73 | 1000 | 990 |
| 7 | 10 | 4 | 1.0 | 1.0 | 1.5 | 1.5 | 18.0 | 24 | 0.75 | 1000 | 1000 |
| 8 | ↑ | ↑ | ↑ | ↑ | ↑ | 1.25 | 18.5 | 24 | 0.77 | 1000 | 1000 |
| 9 | ↑ | ↑ | ↑ | ↑ | ↑ | 1.0 | 19.0 | 24 | 0.79 | 1000 | 1000 |
| 10 | 10 | 4 | 2.0 | 2.0 | 1.0 | 1.5 | 19.0 | 24 | 0.79 | 1000 | 1000 |
| 11 | 10 | 4 | 2.0 | 2.0 | 1.0 | 1.0 | 20.0 | 24 | 0.83 | 1000 | 1000 |
| 12 | 10 | 4 | 2.0 | 1.0 | 1.5 | 1.25 | 19.5 | 24 | 0.81 | 1000 | 1000 |
| 13 | 10 | 4 | 2.0 | 1.0 | 1.5 | 1.5 | 19.0 | 24 | 0.79 | 1000 | 995 |
| 14 | 10 | 4 | 2.0 | 1.0 | 1.5 | 1.75 | 18.5 | 24 | 0.77 | 1000 | 990 |
| 15 | 10 | 4 | 2.0 | 1.0 | 1.5 | 2.0 | 18.0 | 24 | 0.75 | 1000 | 980 |
| 16 | 10 | 4 | 2.0 | 1.0 | 1.5 | 1.0 | 20.0 | 24 | 0.83 | 1000 | 1000 |
| 17 | ↑ | ↑ | ↑ | ↑ | ↑ | 0.75 | 20.5 | 24 | 0.85 | 1000 | 1000 |
| 18 | 10 | 4 | 2.0 | 2.0 | 1.0 | 1.0 | 20.0 | 24 | 0.83 | 1000 | 1000 |
| 19 | 10 | 4 | 3.0 | 3.0 | 0.5 | 0.5 | 22.0 | 24 | 0.91 | 1000 | 1000 |
| 20 | 10 | 4 | 2.6 | 2.6 | 0.2 | 0.2 | 23.2 | 24 | 0.97 | 1000 | 1000 |

As seen from Table 1, it is understood that a temperature difference between portions A and B is very small when a ratio of x/y is greater than 0.73. It is necessary to form concave-convex portions at the inner surface of the heater body in order to make a ratio of x/y greater than 1.0, which results in complication of manufacturing processes. It is therefore preferable to make a ratio of x/y to be in a range of 0.73 to 1.0.

Figure 14:
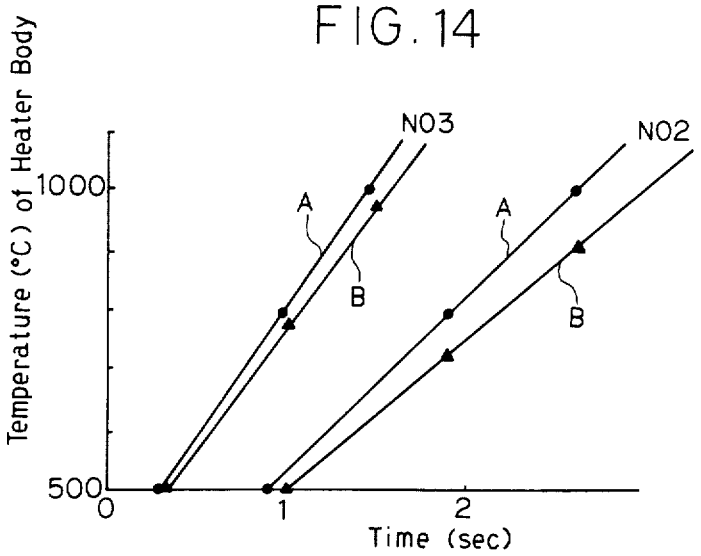
FIG. 14 is a graph showing experimental results between the present invention and the prior art.

FIG. 14 shows an experimental result, in which the temperatures at the portions A and B are measured for Samples No. 2 and No. 3. It is seen from FIG. 14 that the temperature difference between the portions A and B of Sample No. 3 is smaller than that of Sample No. 2 and that Sample No. 3 is more quickly heated than Sample No. 2.

Table 2 shows experimental test results, in which a mixing ratio of $MoSi_2$ and $Si_3N_4$ is varied and each value is measured.

Conditions of Test and Measurement (i) Oxidization resistive test:
1000° C.
15 hr
ambient atmosphere (ii) Breaking strength:
test piece: 40×3×4 mm
load speed: 0.5 mm/min
Maximum breaking strength: a load by which a test piece is broken in a three-point bending test at 1300° C.

(iii) Thermal expansion coefficient:
average coefficient among a room temperature and a temperature of 800° C.

TABLE 2

| Ratio (mol %) | $MoSi_2$ / $Si_3N_4$ | 100 / 0 | 90 / 10 | 80 / 20 | 70 / 30 | 60 / 40 | 50 / 50 | 40 / 60 | 30 / 70 | 20 / 80 | 10 / 90 | 0 / 100 |
|---|---|---|---|---|---|---|---|---|---|---|---|---|
| Oxidization Resistance Test weight change (%) | | 0.03 | 0.04 | 0.03 | 0.04 | 0.04 | 0.04 | 0.03 | 0.05 | 0.04 | 0.04 | 0.05 |
| Maximum Breaking Strength (Kg/cm$^2$) | | 5 | 10 | 13 | 15 | 19 | 27 | 29 | 36 | 42 | 51 | 60 |
| Thermal Expansion Coefficient (°C.$^{-1}$) | | $7.7\times10^{-6}$ | $7.1\times10^{-6}$ | $6.3\times10^{-6}$ | $5.7\times10^{-6}$ | $5.0\times10^{-6}$ | $4.4\times10^{-6}$ | $3.3\times10^{-6}$ | $3.5\times10^{-6}$ | $3.2\times10^{-6}$ | $3.0\times10^{-6}$ | $2.8\times10^{-6}$ |
| Specific Resistance (Ω-cm) | | $2.8\times10^{-4}$ | $1.4\times10^{-3}$ | $3.5\times10^{-3}$ | $1.5\times10^{-2}$ | $4.0\times10^{-2}$ | $1.2\times10^{-1}$ | $4.0\times10^{-1}$ | 2.0 | 3.8 | $4.2\times10^{3}$ | ∞ |

THIRD EMBODIMENT

Figure 15:
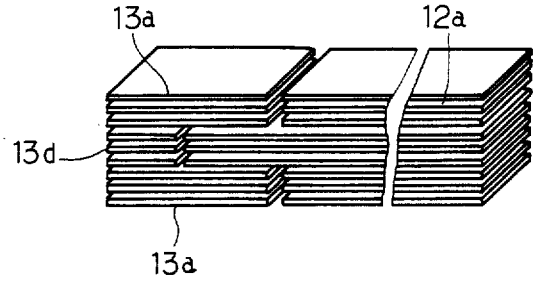
FIG. 15 is a perspective view of a heating section according to a third embodiment of the present invention.
Figure 16:
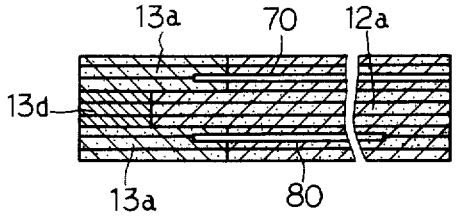
FIG. 16 is a side view of the heating section.
Figure 17:
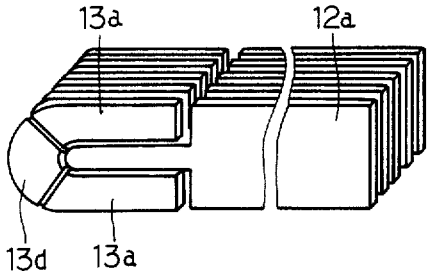
FIG. 17 is a perspective view of a heating section of a modification of the third embodiment.

A third embodiment of the present invention will be explained with reference to FIGS. 15 and 16.

A plurality of green sheets 12*a* made of a mixture of $Al_2O_3$ and $Si_3N_4$ and a plurality of green sheets 13*a* and 13*d* made of a mixture of $MoSi_2$ and $Si_3N_4$ are prepared, wherein a mixing ratio of $MoSi_2$ and $Si_3N_4$ is so changed that a specific resistance value of the green sheets 13*d* is greater than that of the green sheets 13*a*. The green sheets 12*a*, 13*a* and 13*d* are then sintered together with metal lead wires 70 and 80 as in the above explained first and second embodiments, to form a heating section as shown in FIG. 16.

Since the specific resistance value at the forward end 13*d* of the U-shaped heater body is greater than the other portions 13*a*, as explained above, the whole heater body can be uniformly heated.

Table 3 shows experimental test results for Samples A to I, wherein a mixing ratio of $MoSi_2$ and $Si_3N_4$ is varied and a temperature difference between the forward end 13*d* and other portions (leg portions) 13*a* of the heater body is measured.

As seen from Table 3, the temperature difference of Sample C, D, H or I is smaller than 30° C. and these samples are preferable.

In these samples C, D, H and I, the specific resistance value of the forward end is greater by at least two times than that of the leg portions.

TABLE 3

| Sample | | A | B | C | D | E | F | G | H | I |
|---|---|---|---|---|---|---|---|---|---|---|
| Portions 13a | $MoSi_2$ (mol %) | 80 | 80 | 80 | 80 | 70 | 70 | 70 | 70 | 70 |
| | $Si_3N_4$ (mol %) | 20 | 20 | 20 | 20 | 30 | 30 | 30 | 30 | 30 |
| | Specific Resistance value (Ω· cm) | $3.5 \times 10^{-3}$ | $3.5 \times 10^{-3}$ | $3.5 \times 10^{-3}$ | $3.5 \times 10^{-3}$ | $1.5 \times 10^{-2}$ | $1.5 \times 10^{-2}$ | $1.5 \times 10^{-2}$ | $1.5 \times 10^{-2}$ | $1.5 \times 10^{-2}$ |
| Forward End 13d | $MoSi_2$ (mol %) | 100 | 80 | 75 | 70 | 80 | 70 | 67 | 64 | 60 |
| | $Si_3N_4$ (mol %) | 0 | 20 | 25 | 30 | 20 | 30 | 33 | 36 | 40 |
| | Specific Resistance value (Ω · cm) | $2.8 \times 10^{-4}$ | $3.5 \times 10^{-3}$ | $0.9 \times 10^{-2}$ | $1.5 \times 10^{-2}$ | $3.5 \times 10^{-3}$ | $1.5 \times 10^{-2}$ | $2.3 \times 10^{-2}$ | $3.1 \times 10^{-2}$ | $4.0 \times 10^{-2}$ |
| Temperature Difference (°C.) | | 150 | 100 | 0 | 0 | 120 | 90 | 70 | 30 | 0 |

What is claimed is:

1. A ceramic heater device comprising:

a metal housing;

a central electrode electrically insulated from and attached to said metal housing, one end of said central electrode being positioned within said metal housing;

a sintered ceramic insulator, one end of which is inserted into said metal housing and attached to said metal housing, the other end of said sintered ceramic insulator being extending outwardly from said metal housing;

a sintered ceramic U-shaped heater body fixed to said other end of said sintered ceramic insulator so that said heater body is electrically insulated from said metal housing by means of said ceramic insulator, said U-shaped ceramic heater body comprising:

a forward end; and a pair of leg portions extending from said forward end towards said metal housing, the specific resistance value of said forward end being more than twice as great as that of said leg portions; and a pair of metal lead wires embedded in said insulator and said heater body, one end of each said metal lead wire being electrically connected to respective ones of said leg portions of said U-shaped heater body at one end of said U-shaped heater body and an opposite end of each said metal lead wire being exposed to an outer surface of said ceramic insulator, and one of said exposed ends being electrically connected to said metal housing while the other said exposed end being electrically connected to said one end of said central electrode.

2. A ceramic heater device as set forth in claim 1, further comprising:

a metallized layer formed on the outer surface of said sintered ceramic insulator at such a portion where one of said other ends of said metal lead wires is exposed; and a metal sleeve attached to said metal housing at its outer peripheral surface, said ceramic insulator being inserted into said sleeve so that said metallized layer is electrically connected thereto.

3. A ceramic heater device as set forth in claim 2, further comprising:

a metallized layer formed on the outer surface of said sintered ceramic insulator at such a portion where the other end of said metal lead wires is exposed, wherein said other end is electrically connected to said central electrode through said metallized layer.

4. A ceramic heater device as set forth in claim 1, wherein a ratio of x/y is selected to be in a range of 0.73 to 1.0, both inclusive, wherein x is a length of an inner path of said U-shaped ceramic heater body, while y is a length of an outer path of said U-shaped ceramic heater body.

5. A ceramic heater device as set forth in claim 1, wherein said leg portions are made of a mixture of 70 mol% of $MoSi_2$ and 30 mol% of $Si_3N_4$, and said forward end is made of a mixture of 60 to 64 mol% of $MoSi_2$ and 36 to 40 mol% of $Si_3N_4$.

* * * * *